US006729608B1

(12) United States Patent
Del Sole

(10) Patent No.: US 6,729,608 B1
(45) Date of Patent: May 4, 2004

(54) CARBURETOR FLOAT BOWL DRAIN SCREW WITH QUICK DISCONNECT COUPLING

(75) Inventor: Robert Joseph Del Sole, Larchmont, NY (US)

(73) Assignee: Robert J. Del Sole, Larchmont, NY (US)

( * ) Notice: Subject to any disclaimer, the term of this patent is extended or adjusted under 35 U.S.C. 154(b) by 0 days.

(21) Appl. No.: 10/320,007

(22) Filed: Dec. 16, 2002

(51) Int. Cl.[7] ..... F02M 5/12

(52) U.S. Cl. ..... 261/38; 141/364; 222/110; 251/216; 261/70; 261/71; 261/72.1; 261/DIG. 67

(58) Field of Search ..... 261/38, 70, 71, 261/72.1, DIG. 21, DIG. 38, DIG. 67; 141/364; 222/110, 489, 390, 552, 568; 251/216; 184/106

(56) References Cited

U.S. PATENT DOCUMENTS 1,625,572 A * 4/1927 Simpson ..... 261/46
1,734,232 A * 11/1929 Ryan et al. ..... 222/519
1,859,126 A * 5/1932 Boeuf ..... 222/505
3,184,091 A * 5/1965 Hoffman ..... 217/99
4,986,502 A * 1/1991 Ceroke ..... 251/216
5,368,181 A * 11/1994 Myers ..... 220/303
5,653,270 A * 8/1997 Burrows ..... 141/18
6,244,572 B1 * 6/2001 Delsole ..... 261/38

* cited by examiner

*Primary Examiner*—Richard L. Chiesa

(57) ABSTRACT

An elongated drain screw mechanism having a solid front end disposed in the fuel bowl of a carburetor. The mechanism has an intermediate section disposed in the bowl the intermediate section having at least one transverse opening into which fuel in the bowl can flow, and a rear section extending through the bowl to the outside of the bowl. The rear section has a hollow open end and has a longitudinal channel connected to the transverse opening and communicating with the hollow open end. A first quick disconnect coupler is disposed in and seals said open end of the rear section. The first coupler has a normally closed position which blocks fuel flow and can be placed in open position at which fuel can flow.

1 Claim, 2 Drawing Sheets

CARBURETOR FLOAT BOWL DRAIN SCREW WITH QUICK DISCONNECT COUPLING

BACKGROUND OF THE INVENTION

U.S. Pat. No. 6,244,572 discloses a carburetor bowl drain screw and recovery system that permits fuel to be safely drained from a carburetor in an environment that could otherwise be hazardous such as a hot engine. The bowl is disposed vertically. A drain screw is inserted in the bowl adjacent its lower end and extends outwardly therefrom. An end of the screw within the bowl has channels into which the fuel in the bowl can flow by gravity action. The other end of the screw has an aperture through which fuel can be discharged. The screw has a locked position at which fuel flow is blocked and an unlocked position at which the fuel can be discharged and collected via a hose connected from the other end of the screw into an appropriate collection vessel. In order to place the screw in either position it is necessary to use a wrench to change the position of the screw. At the same time, it is necessary to avoid loosening the connection of the screw to the bowl. A second wrench is used to maintain the proper connection of the screw when it is either locked or unlocked.

SUMMARY OF THE INVENTION

The present invention is directed toward a new type of carburetor bowl drain screw and recovery system. In particular, the invention employs a novel screw mechanism having one open end inserted in the bowl and an opposite open end disposed outside the bowl. The mechanism is secured to the bowl in a leak proof manner and has at least one longitudinal conduit through which the fuel in the bowl can be conducted by gravity action. The opening in the opposite end is sealed by a first disconnect coupler. This first coupler is normally closed and blocks fuel flow. The first coupler can be opened by manual action and permits the fuel to be discharged.

However the invention also employs a hose open at one end and secured at its other end to a fuel collection vessel. This one hose end contains a second quick disconnect coupler that is also normally closed. These two couplers are adapted for snap connection to each other and when so connected by hand they are both open and permit fuel to flow through the screw, couplers and hose for collection in the vessel.

The use of two quick disconnect couplers enables the use of a novel and simplified screw mechanism and substitutes a simple hand motion for use of wrenches. These couplings are well known in the art and are manufactured and sold commercially.

DETAILED DESCRIPTION OF PREFERRED EMBODIMENT

Figure 4:
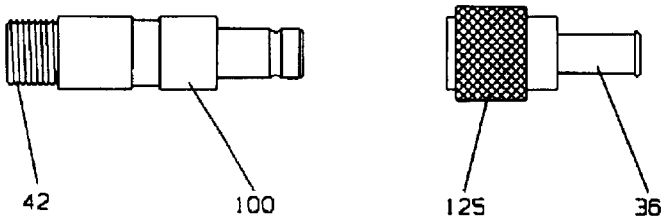
FIG. 4 shows two perspective views of the quick disconnect couplings used in the invention.
Figure 1:
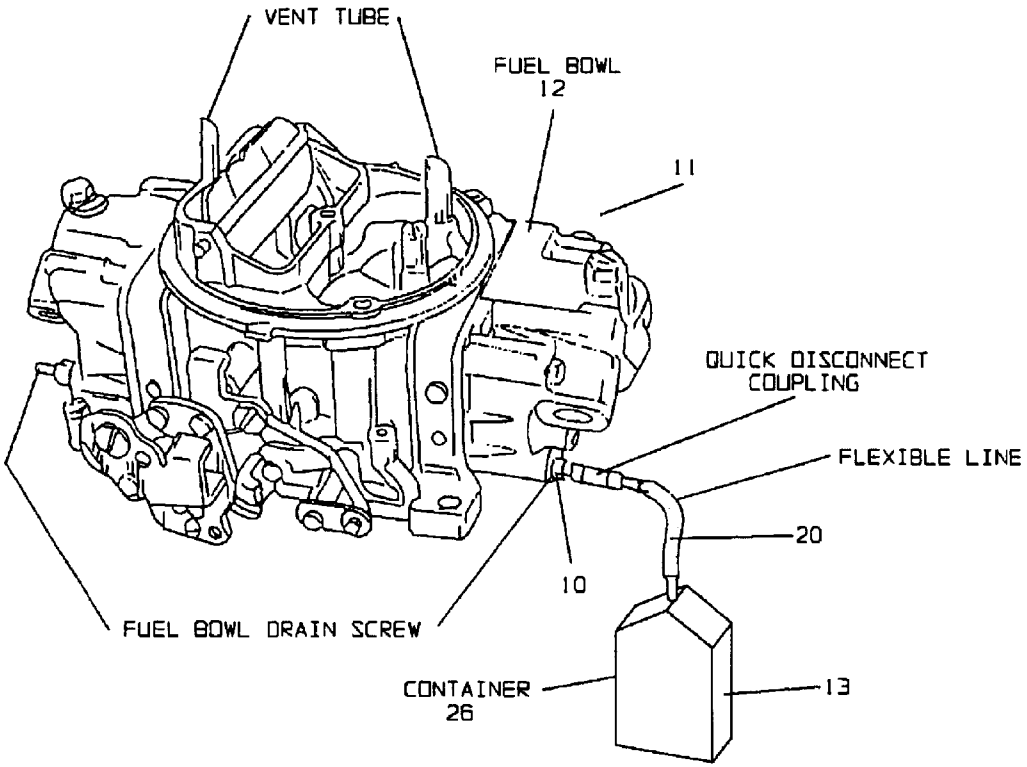
FIG. 1 is a perspective view showing the invention in use.
Figure 3:
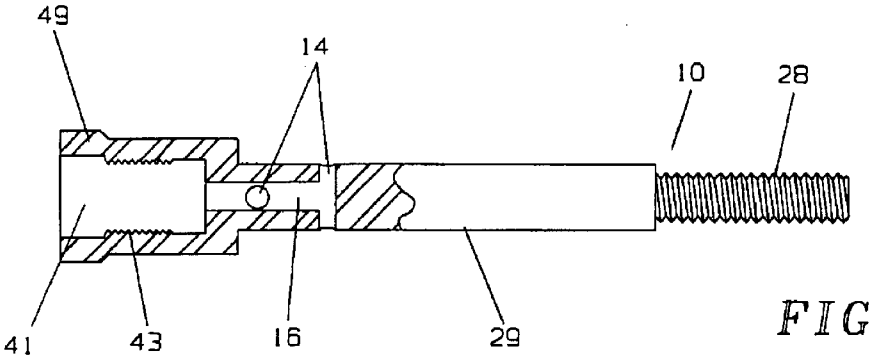
FIG. 3 is a detail cross sectional view of a portion of the fuel bowl with the drain screw mechanism secured thereto in operating position.
Figure 2:
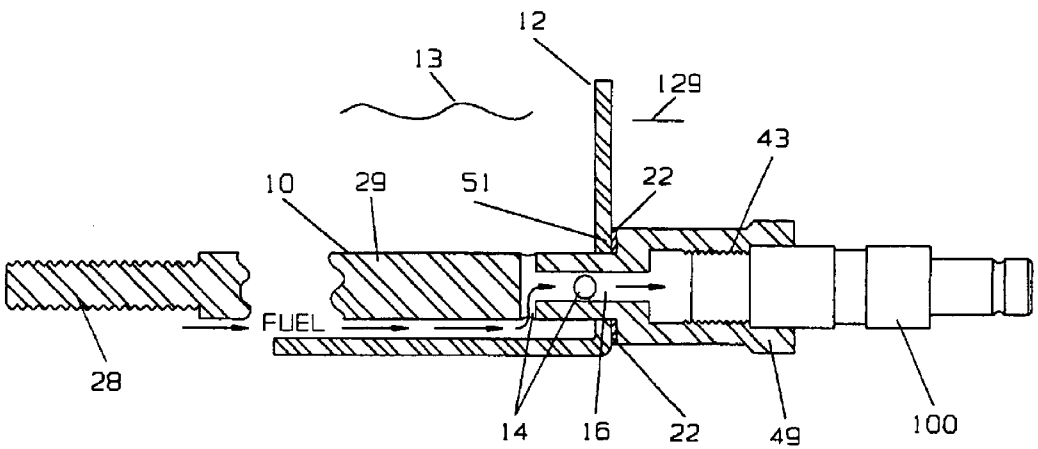
FIG. 2 is a detail longitudinal cross section of the drain screw mechanism.

Referring now to FIGS. 1–4, drain screw mechanism 10 is connected to the fuel bowl 12 of carburetor 11. Mechanism 10 has a solid threaded forward end 28, an intermediate solid portion 29, and a hollow rear end opening 41. Opening 41 has a hollow extension with a longitudinal channel 16. Portion 29 has four transverse holes 14 which are spaced apart and permit fuel to enter the channel. The mechanism will function properly using only one hole, but the use of additional holes increases the rate of fuel flow. A hex head 49 engages end 41 for tightening the mechanism against a gasket 22 that engages the outer wall 129 of the fuel bowl 12.

A first disconnect coupler 100 is threadedly mounted within end 41. Threads 42 mesh with the internal threads 43 of end 41. A second disconnect coupler 125 includes an exit portion 36 having a cylindrical element 36 onto which is mounted one end of a flexible hollow hose or line 20. The other end of line 20 is connected into container 26. Each coupler in normally closed and, blocks fuel flow. Both couplers are connected together by slight forward pressure and are then both opened so that fuel 13 flows by gravity out of the fuel bowl, through the line 20 and into the container. The couplers can be disconnected by slight rearward pressure and prevent further fuel flow.

These couplers are disclosed in a published catalog as series HK 20 sub miniature double shut-off couplers and are used in fluid systems to minimize loss of fluid when connecting or disconnecting fluid lines and to prevent the loss of fluid once disconnected.

In operation, the front end of the screw mechanism is inserted through the float bowl and is tightened so that portion 51 engages gasket 22 against the bowl outer wall 129. This prevents leakage of fuel between the mechanism and the bowl when the two couplers are connected together to allow fuel flow as explained above.

While the invention has been described with particular reference to the preferred embodiment, the protection solicited is to be limited only by the terms that follow.

What is claimed is:

1. In combination with a vertically upright fuel bowl of a carburetor, said bowl having a closed lower end:

an elongated drain screw mechanism having a solid front end disposed in said bowl adjacent the bowl lower end, an intermediate section in the bowl, the intermediate section having at least one transverse opening into which fuel in the bowl can flow, and a rear section extending through the bowl to the outside of the bowl, said rear section having a hollow open end and having a longitudinal channel connected to the transverse opening and communicating with the hollow open end; and a first quick disconnect coupler disposed in and sealing said open end of the rear section, said first coupler having a normally closed position which blocks fuel flow and can be placed in an open position at which fuel can flow; and further including a second coupler engageable with the first coupler and having a normally closed position, both couplers being placed in open position when engaged; and the second coupler having a cylindrical element onto which is mounted a flexible hollow hose or line, the other end of the line is connected to a container.

* * * * *